US005485703A

United States Patent [19]

Nordahl

[11] Patent Number: 5,485,703

[45] Date of Patent: Jan. 23, 1996

[54] CONSTRUCTION ASSEMBLY INCLUDING A RECTANGULAR BLOCK FOR DRY WALLING OR THE PERMANENT CONSTRUCTION OF A WALL OR PARTITION

[76] Inventor: Willy Nordahl, Opseth, Rute 975, N-2400 Elverum, Norway

[21] Appl. No.: 277,636

[22] Filed: Jul. 20, 1994

[51] Int. Cl.[6] ..... E04C 1/10

[52] U.S. Cl. ..... 52/562; 52/600; 52/605; 52/606; 52/607; 52/585.1

[58] Field of Search ..... 52/600, 604–607, 52/562, 564, 565, 568, 586.1; 446/122

[56] References Cited

U.S. PATENT DOCUMENTS

| | | | |
|---|---|---|---|
| 738,643 | 9/1903 | Van Camp | 52/605 X |
| 785,296 | 3/1905 | Dunn | 52/607 |
| 790,507 | 5/1905 | Lamberson | 52/605 |
| 803,380 | 10/1905 | Wickre | 52/605 |
| 844,416 | 2/1907 | Sewall | 52/605 |
| 2,029,586 | 2/1936 | Rendoff | 52/604 X |
| 2,228,363 | 1/1941 | Pinney | 52/562 |
| 3,475,873 | 11/1969 | Steadman | 52/562 |
| 5,191,744 | 3/1993 | Bowes | 52/564 |

FOREIGN PATENT DOCUMENTS

| | | | |
|---|---|---|---|
| 1091630 | 11/1954 | France | 52/605 |

*Primary Examiner*—Carl D. Friedman
*Assistant Examiner*—Robert J. Canfield
*Attorney, Agent, or Firm*—Young & Thompson

[57] ABSTRACT

A construction member, preferably a rectangular block (1), for dry walling or the permanent construction of, for example, a wall or partition, where the opposing faces of the blocks (1) body in the form of a strip (3) which fits into the opposing slots (2) of the blocks (1). The slots (2) are V-shaped and the cross-section of the strip (3) is adapted to conform to the cross-sectional opening of the two opposing V-slots (2) for achieving a guiding/locking effect between the adjacent faces of the blocks (1).

3 Claims, 2 Drawing Sheets

CONSTRUCTION ASSEMBLY INCLUDING A RECTANGULAR BLOCK FOR DRY WALLING OR THE PERMANENT CONSTRUCTION OF A WALL OR PARTITION

The present invention relates to a construction assembly includes a rectangular block, for dry walling or the permanent construction of e.g., a wall or partition.

Rectangular building blocks or members, having corresponding grooves and tongues in the opposing side faces thereof designed to come into engagement with one another during the building/assembly of, for instance, the partitions in a house or a wall or other similar structures, are previously known.

Thus, the use of respectively interacting grooves and tongues is known, as is the use of loose tongues which are placed in the slot in the one member, whereupon the groove in the second member is brought into engagement with the tongue as the member is put into place. Such grooves or slots can be semi-circular or rectangular in cross-section in order to be capable of being adjusted to accommodate either loose tongues or strips having a cross-section corresponding to that of the channel formed by the slots when the members are juxtaposed.

A construction member in the form of a rectangular building block having rectangular slots of this kind is shown, e.g., in DOS-1.907.143.

The disadvantage of rectangular slots in building blocks of this kind is that the guiding and locking strips which are to interact with the slots, must be placed in exactly the right position relative to the slot so as to be capable of being pushed therewithin transverse to the longitudinal direction of the slot. The same applies to the location of blocks with slots of this kind on top of such strips having a rectangular cross-section.

The objective of the present invention is to produce construction members, e.g., rectangular building blocks, where the aforementioned disadvantages do not occur, which according to the invention, is achieved by means of the features which are disclosed hereinafter.

By providing the blocks with a V-shaped slot, an advantage is also achieved when producing the building blocks by means of moulding, in addition to the disclosed guiding/locking effect between the adjacent faces with the aid of strips located in the slots, which fill the channel formed by the two opposing V-shaped slots.

Today, building blocks are moulded of relatively dry substances in moulds, which substances are subjected to vibration and pressure, the moulding mix thereby becoming so mechanically strong that the moulds can be removed immediately in order to be filled again to mould more blocks. If blocks are to be moulded with one or more rectangular slots in the under side and upper side thereof, a strong compression of the moulding mix will occur in the regions where the sides of the moulds equipped with protruding strips or projections for the formation of said slots, are pressed against the dry moulding mix, normally against the under side and upper side of the block. The said faces of the block will, on the other hand, be substantially less compressed and the moulding mix will thus be relatively loose in said side faces of the block.

By providing a V-shaped slot in the upper side and the under side of the block, and also optionally in the end faces thereof, the pressure faces of the mould having projections or protruding strips triangular in cross-section for the formation of the V-shaped slots, will, during moulding, force the moulding mix down and out to the sides, which results in a more even compression of the moulding mix in the whole block being obtained. Said V-shaped slots in the building block are also substantially easier to press as compared to a rectangular slot, as the projection having a triangular cross-section on the pressure faces of the mould, penetrates into the moulding mix and displaces it more easily than a corresponding projection having a rectangular cross-section would have done. Furthermore, the ejection achieved, i.e., the releasing and removal of the moulds from the moulded blocks, is simpler since said projections having a triangular cross-section loosen more easily from the formed V-slot, as the projection does not draw with it concrete, in the same way as, e.g., a rectangular projection, where the parallel sides of said projection will slide up along the walls of the slot during the removal of the mould sections from the blocks.

Additional advantages provided by the present invention will be made apparent in the subsequent specification of the invention with reference to the drawing where:

Figure 5:
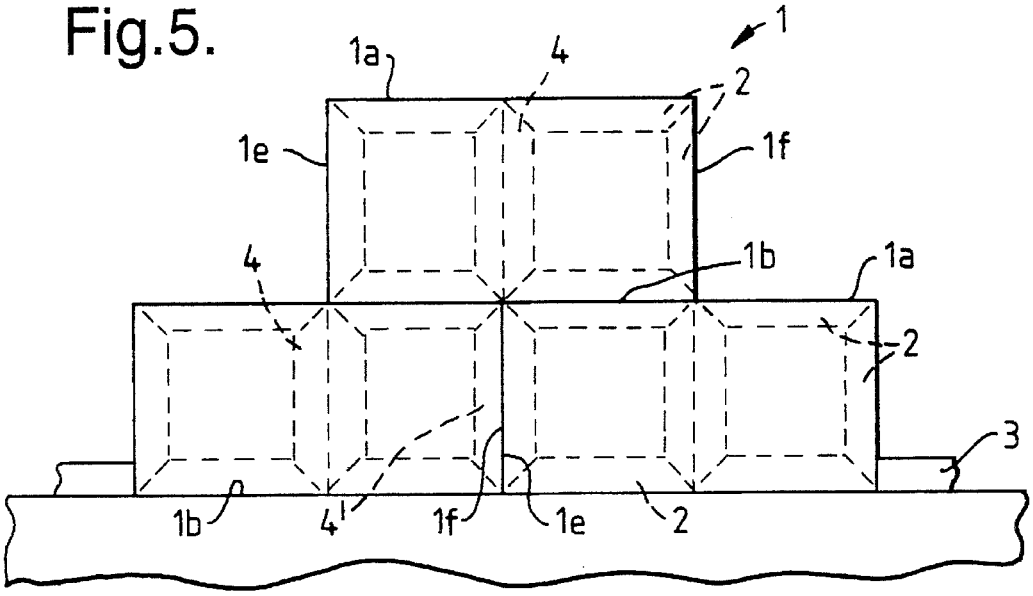
Figure 6:
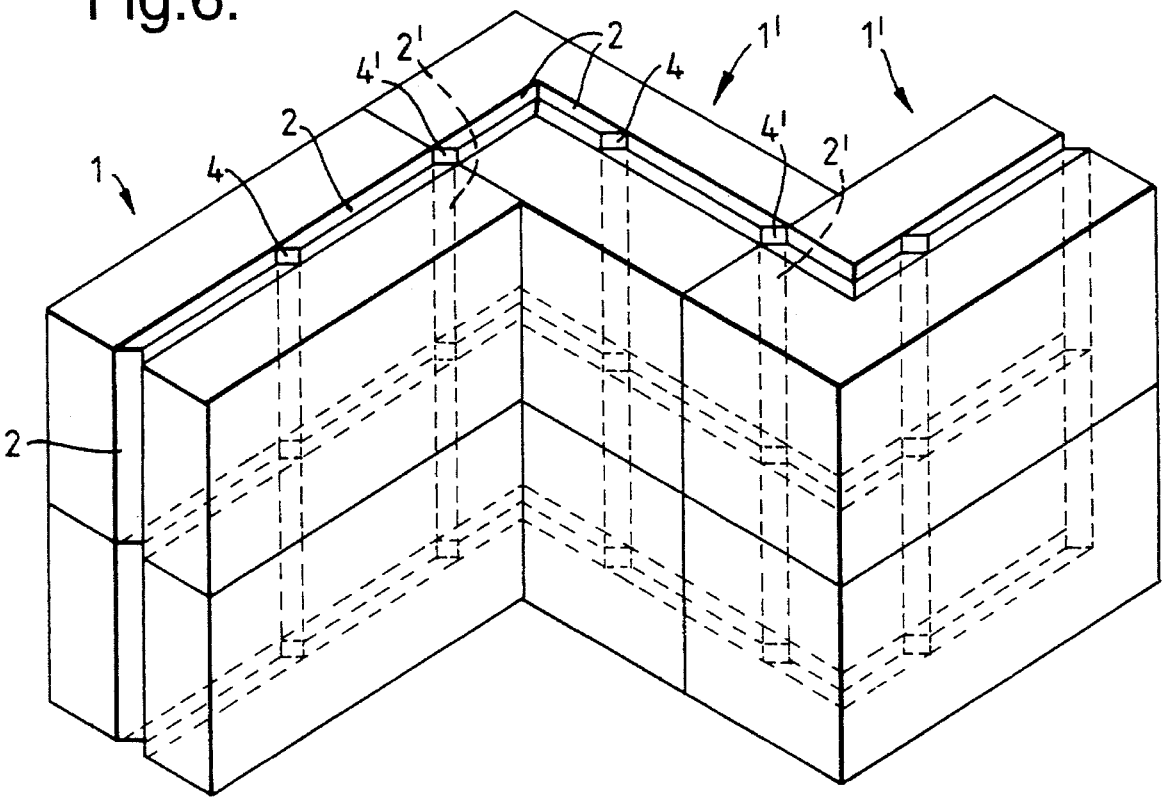

FIG. 5 illustrates three blocks placed in bond for erecting a partition or a wall on a levelled sole having a guiding strip; and FIG. 6 shows an example of the construction of a wall having a 90° deflection in two opposite directions by means of a block having a V-shaped slot designed for positioning the blocks at right angles to one another with V-slots continuing in alignment in the opposing faces.

Figure 1:
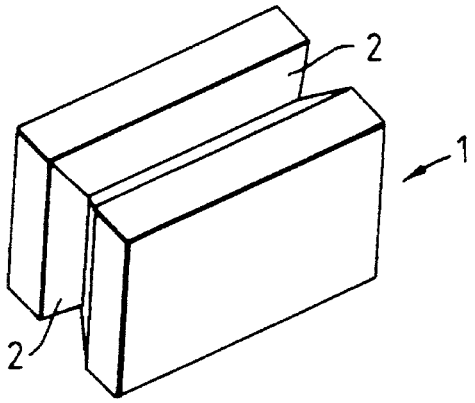
FIG. 1 shows a building block according to the invention in perspective.

The construction member according to the invention, preferably in the form of a rectangular block 1 as shown in perspective in FIG. 1, comprises V-shaped slots 2 which extend around four of the faces of the block, viz., a V-slot in each of the upper and lower faces of the block, which continue as corresponding V-slots 2 in the end faces of the block. As shown in FIG. 1, the V-slot is placed in the longitudinal plane of symmetry of the block and with the bisecting angle of the V-slot at right angles to the face. The angle of the V-slot is preferably 9°. In this way, one obtains two opposing slots in two adjacent blocks that form a square opening or channels 4' having a square cross-section. Said channels 4' formed with and by the V-slots 2 are thus designed to interact with guiding/locking bodies in the form of strips 3, preferably with a square cross-section, that fit in said V-slot 2 or square channels 4'. The blocks are preferably also provided with a throughgoing channel 4 from the upper face 1*a* of the block 1, when said block is in a position of use, to the lower face 1*b* thereof and at right angles thereto. The channel 4 having a cross-sectional form corresponding to aforementioned channel 4' is preferably located such that it extends between the V-slots 2 in said upper and lower faces 1*a*,1*b*.

As mentioned above, the V-slots 2 are right-angled, but they can, of course, also form obtuse or acute angles if so desired. In this event, the strip 3 must be made to conform to the form of the V-slots.

Figure 2:
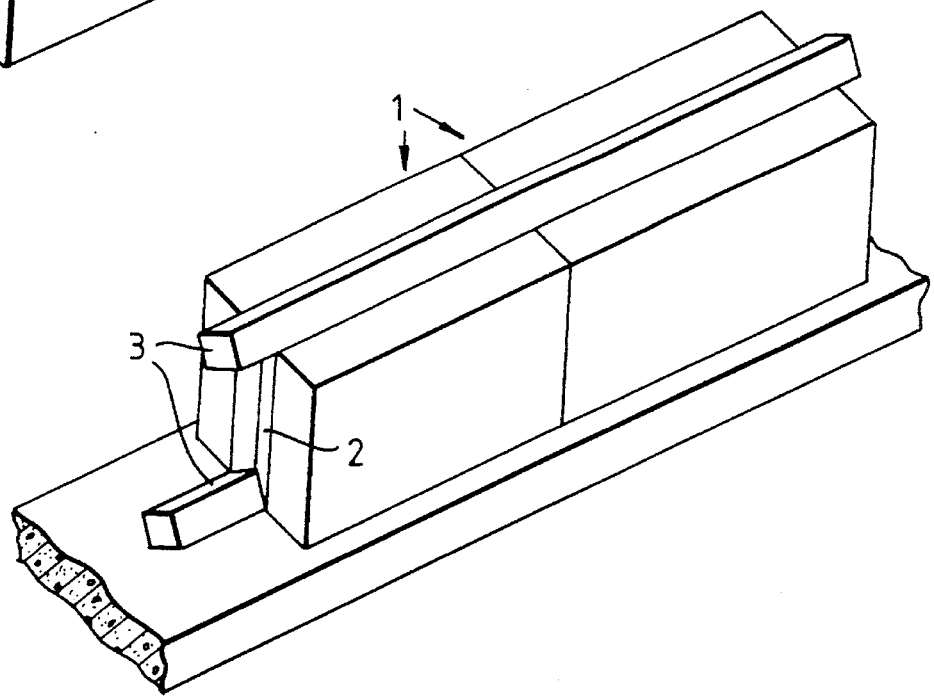
FIG. 2 shows two blocks placed end to end with a guiding/locking member in the form of a strip placed in the upturned V-shaped slots, seen in perspective.
Figure 3:
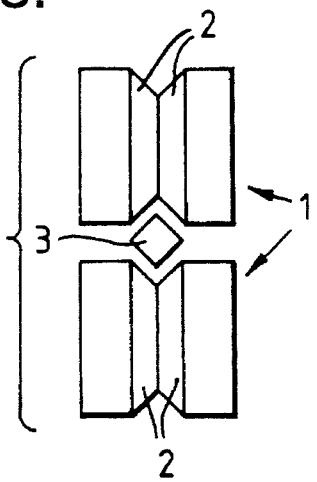
FIG. 3 illustrates two blocks and an intermediate strip seen from the end and spaced apart from one another.
Figure 4:
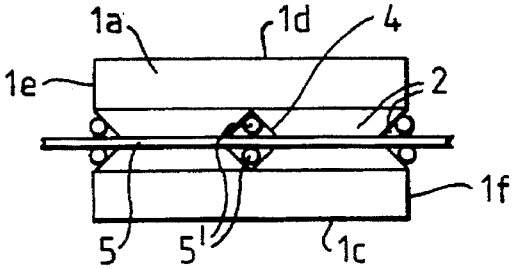
FIG. 4 show a block seen from above with a throughgoing channel and inserted horizontal and vertical reinforcing rods.

A wall or partition can be built by means of the construction member described above in the form of a rectangular block that is preferably moulded in concrete, but which can also be of any other material. In FIG. 2, two blocks 1 are thus shown positioned end to end on a levelled base having a guiding/locking strip 3 embedded therein for guiding and locking during the laying of the first course of blocks 1. The lower strip 3 can, of course, be triangular having an upturned back, the faces of which form a right angle with one another, which strip is secured to the base with the aid of expedient means, e.g., by means of bolts (not shown). The wall/partition can then be built further by continuing to lay the blocks 1 in the first course and thereafter beginning a second course such as is shown in FIG. 5, where one block 1 has been placed in bond on two subjacent blocks 1. In that the blocks 1 are provided with throughgoing channels 4 as described in the foregoing, and as shown in FIGS. 4, 5 and 6, the blocks, in the courses positioned one on top of the other, can be locked relative to one another by means of strips 3 placed in the vertical channels which are formed respectively by the channel 4 in the block 1, and which are in alignment with the channel 4' which is formed by the V,slots 2 in the opposing end faces 1*e,f* of the blocks 1.

By using said strips 3, one can thus construct a dry wall or dry partition of blocks 1 for permanent use or one that can be pulled down later and rebuilt on other sites. This can, e.g., be extremely advantageous when building partitions and walls in connection with exhibitions, or for demarcating areas, or in connection with so-called exhibitions stands.

It shall also be pointed out that the blocks produced in appropriately small dimensions, can be used as toy building blocks for children. On the other hand, the blocks, in the form a very large construction members, can also be used for building large, heavy walls for different purposes. The blocks can, for instance, be made in the form of lighters, e.g., moulded in reinforced concrete, which are floated out to a construction area for the erection of a dam or breakwater, where the first lighters, which are to form the first course against the bottom, are positioned on a levelled base in that the lighters are sunk, whereupon additional lighters are floated into place above the first sunken lighters and are laid in bond on top of said first course of lighters by being submerged down on to these and, of course, having inserted guiding/locking bodies in the form of strips 3 in the V-shaped slot 2 of the lighters (blocks 1).

For the permanent erection of a partition or wall, the blocks 1 can be bonded by means of liquid mortar which is poured into the vertical channels 4', which liquid mortar will flow out to the side in the horizontal channels 4' formed by the opposing V-slots 2 of the blocks 1. This is subject to both vertical and horizontal strips 3 being withdrawn from said channels 4,4'. Once the strips 3, which are used when erecting the wall, have been withdrawn, reinforcing rods can be placed in the upturned V-slots 2 in the first course instead of guiding strips, whereupon the second course of blocks is laid and so on until one has the required number of courses. By centring the horizontal reinforcing rods 5 in the V-shaped slots 2, as shown in FIG. 4, vertical reinforcing rods 5' can be fed into the vertical channels 4,4' on either side of the horizontal reinforcing rod 5 due to the square cross-sectional shape of the channels 4,4' forming triangular openings on either side of the horizontal reinforcing rod. Subsequently, the whole structure is bonded by means of filling the vertical channels 4,4' with liquid mortar in the same way as described above.

In order to be able to build walls/partitions with right-angled corners, the V-slots 2 in the upper and lower faces 1*a*,1*b* of the block 1, are at the end of the block 1, deflected at right angles towards one of the side faces 1*c*,1*d* of the block 1 and thereafter extend thereacross at a distance from the end faces 1*e*,1*f* of one block 1 equivalent to the distance of the slots 2 from the respective edges of the block faces. The ratio between the length L of the block and the width W thereof is equal to 2:1.

Subject to the V-slots 2 being located centrally in the respective block faces, the slot 2' which extends across the side faces 1*c* or 1*d* of the block will then be at a distance from the end faces 1*e*,1*f* of the one block equivalent to a quarter of L.

By turning the block 1' at said V-slot 2' 180° and/or turning the block 1' upside down, one can, from one direction of the block course, effect a deflection of the direction to the right or the left, which is illustrated in FIG. 6, where the two courses of blocks 1 and 1' are built with two corners which require a square deflection to the right and thereafter a square deflection to the left respectively.

The blocks 1 can, of course, be manufactured with two parallel V-slots 2 located so as to be equidistant from either of the centre lines in the respective block faces. An advantage which is achieved hereby is that horizontal and vertical reinforcing rods 5,5' can thereby be placed, independent of one another, in the two sets of vertical and horizontal channels 4,4', which are thereby formed in the erected partition/wall. By thus placing the horizontal reinforcing rods in one of the sets of channels 4,4', the vertical reinforcing rods 5' can be placed in the second set of channels 4,4', without coming into conflict with the horizontal reinforcing rods 5.

By means of the present invention, a construction member/building block 1 is produced that can be used for very different building purposes depending upon the dimensions of the construction members/building blocks, and thus in the one extreme they can be used as toy building blocks, and in the other extreme they can be used in the form of lighters for building walls in connection with harbours installations where breakwaters and wharfs are to be built as described in the foregoing.

I claim:

1. A construction assembly comprising in combination a rectangular block and at least one reinforcing rod, said block having on four sides thereof V-shaped slots extending lengthwise of each of said four sides, and a reinforcing rod disposed in at least one of said V-shaped slots, the reinforcing rod being so dimensioned relative to the V-shaped slot in which it is disposed, that the rod contacts the side walls of the V-shaped slot above the bottom of the slot, thereby to leave a space between the rod and the bottom of the slot.

2. A construction assembly as claimed in claim 1, wherein the V-shaped slots are located centrally in said sides of the block.

3. A block according to claim 1, wherein the ratio between the length of the block and the width of the block is equal to 2:1.

* * * * *